US008910589B2

(12) United States Patent
Hinc et al.

(10) Patent No.: US 8,910,589 B2
(45) Date of Patent: Dec. 16, 2014

(54) HIGH-SPEED WIRE COATING DEVICE AND METHOD

(75) Inventors: Henri Hinc, Romagnat (FR); Guy Chevrel, Lezoux (FR)

(73) Assignees: Michelin Recherche et Techniques S.A., Granges-Paccot (CH); Compagnie Generale des Etablissements Michelin, Clermont-Ferrand (FR)

( * ) Notice: Subject to any disclaimer, the term of this patent is extended or adjusted under 35 U.S.C. 154(b) by 763 days.

(21) Appl. No.: 12/995,446

(22) PCT Filed: May 27, 2009

(86) PCT No.: PCT/EP2009/056466

§ 371 (c)(1),
(2), (4) Date: Feb. 23, 2011

(87) PCT Pub. No.: WO2009/144252

PCT Pub. Date: Dec. 3, 2009

(65) Prior Publication Data

US 2011/0143037 A1 Jun. 16, 2011

(30) Foreign Application Priority Data

May 30, 2008 (FR) ..... 08 53572

(51) Int. Cl.
*B05C 3/12* (2006.01)
*D06B 23/24* (2006.01)

(Continued)

(52) U.S. Cl.
CPC . *D06B 23/24* (2013.01); *B05C 3/12* (2013.01); *B05C 3/132* (2013.01);

(Continued)

(58) Field of Classification Search
CPC ..... B05C 3/12; B05C 3/125; B05C 3/132
USPC ..... 118/404, 407, 420, 428, 429
See application file for complete search history.

(56) References Cited

U.S. PATENT DOCUMENTS

| | | | | |
|---|---|---|---|---|
| 4,298,630 | A | 11/1981 | Kapuscinski et al. | |
| 5,571,328 | A * | 11/1996 | Newland | 118/423 |
| 2007/0059448 | A1 | 3/2007 | Smith et al. | |

FOREIGN PATENT DOCUMENTS

| | | |
|---|---|---|
| DE | 43 08 889 | 6/1994 |
| FR | 2 290 257 | 6/1976 |

(Continued)

OTHER PUBLICATIONS

Office Action dated Sep. 2, 2013 issued in the corresponding Japanese Patent Application No. 2011-511005.

*Primary Examiner* — Laura Edwards
(74) *Attorney, Agent, or Firm* — Cozen O'Connor

(57) ABSTRACT

A device is provided for depositing a treatment substance on the surface of a moving thread. The device comprises a tank configured to contain a liquid solution of the substance that is used to deposit the substance on the surface of the thread. The device also includes at least one nozzle having a nozzle inlet configured to receive said solution. The at least one nozzle is directed to spray the received solution towards the thread with a spray velocity in a form of jets, and the jets converge on the thread to adjust a thickness of the solution remaining on the thread by removing excess liquid entrained by the thread. The device further includes a pump that is coupled to the nozzle inlet and a treatment apparatus. The pump is configured to regulate the spray velocity according to a run speed of the thread.

18 Claims, 1 Drawing Sheet

(51) Int. Cl.

| | |
|---|---|
| ***B05C 3/132*** | (2006.01) |
| ***B05D 1/18*** | (2006.01) |
| ***B05D 7/20*** | (2006.01) |
| ***D06B 3/06*** | (2006.01) |
| ***D06B 15/00*** | (2006.01) |
| ***D07B 7/14*** | (2006.01) |
| *B05D 3/02* | (2006.01) |
| *B05D 3/06* | (2006.01) |
| *D07B 1/06* | (2006.01) |

(52) U.S. Cl.

CPC . *B05C 3/125* (2013.01); *B05D 1/18* (2013.01); *B05D 3/0254* (2013.01); *B05D 3/067* (2013.01); *B05D 7/20* (2013.01); *B05D 2256/00* (2013.01); *D06B 3/06* (2013.01); *D06B 15/00* (2013.01); *D07B 1/0666* (2013.01); *D07B 7/145* (2013.01); *D07B 2201/2012* (2013.01); *D07B 2207/404* (2013.01); *D07B 2501/2046* (2013.01)

USPC ..... 118/404; 118/407; 118/420; 118/428; 118/429

(56) References Cited

FOREIGN PATENT DOCUMENTS

| | | | |
|---|---|---|---|
| JP | 59100260 | * | 6/1984 |
| JP | 62151553 A | * | 7/1987 |
| JP | 2003-308745 | | 10/2003 |

* cited by examiner

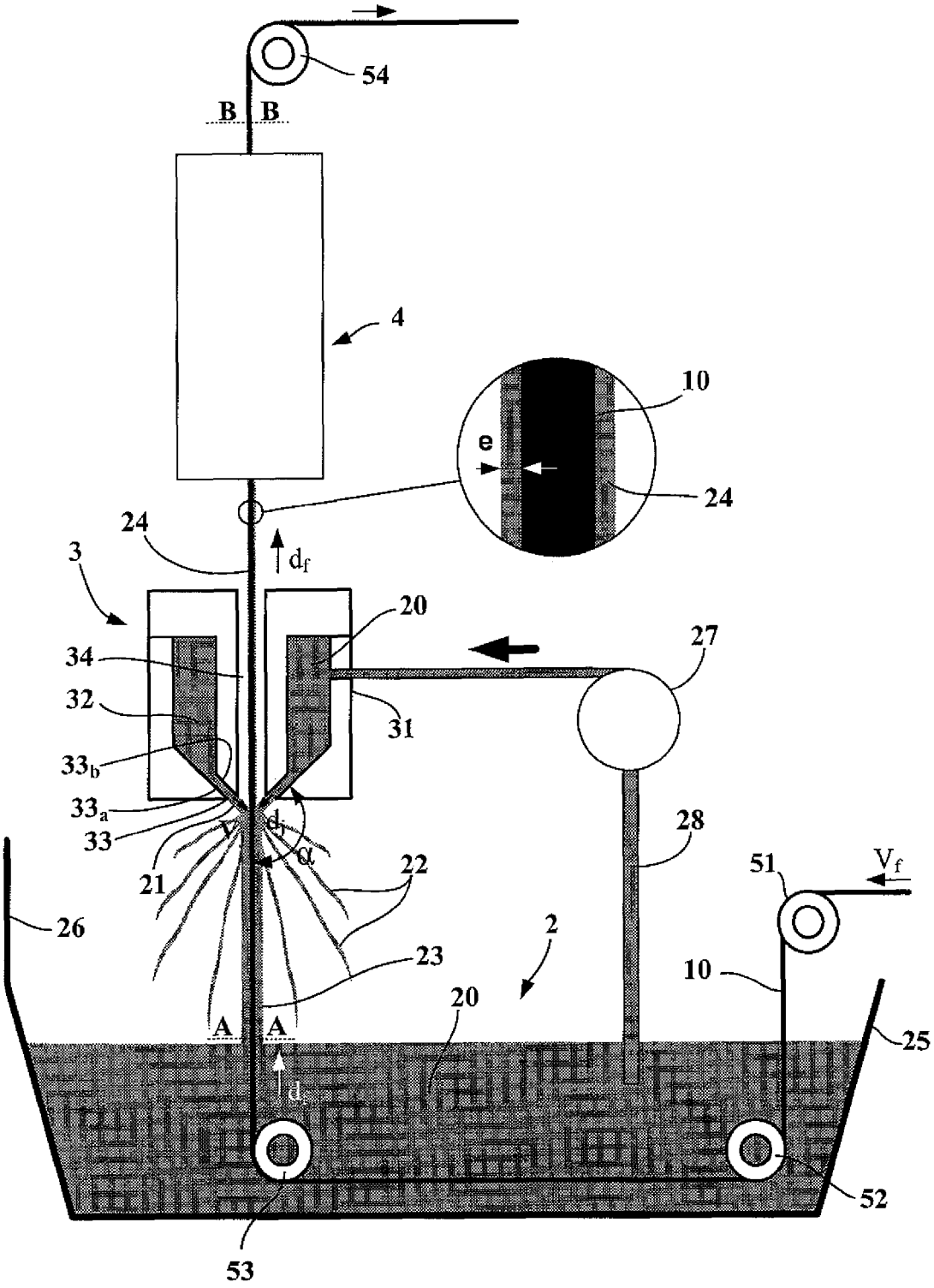
54
B
B
4
10
e
24
24
3
$d_f$
20
27
34
32
31
$33_b$
$33_a$
33
v
$d_i$
α
28
21
22
51
$V_f$
26
2
23
10
20
A
A
25
$d_i$
52
53

HIGH-SPEED WIRE COATING DEVICE AND METHOD

RELATED APPLICATIONS

This is a U.S. national stage of application No. PCT/EP2009/056466, filed on May 27, 2009.

This patent application claims the priority of French patent application no. 08/53572 filed May 30, 2008, the disclosure content of which is hereby incorporated by reference.

FIELD OF THE INVENTION

The invention relates to the field of manufacturing cords and threads and more particularly to the step during which a treatment is carried out on these threads.

BACKGROUND OF THE INVENTION

In many processes, it proves useful to deposit a layer of controlled thickness of a given substance on the surface of the thread so that, in a subsequent manufacturing step, the thread can be processed more easily.

This is the case for example when it is desired to use the thread as a fibre for reinforcing a plastic. It is then necessary to treat the thread so as to make it adhere perfectly to the matrix of the material in question, by depositing a coupling substance on the surface of the thread so as to make the cooperation between these two components as effective as possible. This type of application is widely used in the tire industry or in the reinforced plastics industry.

In the context of the present description, the term "thread" should be understood in a very general sense, covering a monofilament, a multifilament, a cabled or folded yarn or an equivalent assemblage, whatever the material, textile or metallic, of which the thread is made.

More particularly, the invention relates to treatments in which, during a first step, a thin film of a treatment substance is deposited on the surface of the thread in liquid form. This treatment substance may for example be formed from a solvent and an active solute, or else from a substance capable of curing.

The purpose of the following treatment step is to extract the solvent so as to leave on the surface of the thread only the active substance or to allow the curing reaction to be completed, or else to carry out a combination of these two actions.

Very particular attention must therefore be paid to the precise amount of liquid present on the surface of the thread. It is in fact important to ensure that the liquid film deposited, which generally has a small thickness, is as uniform as possible in order to ensure that the properties of the thread are uniform over its entire length.

For this purpose, the known techniques of wetting or coating consist in making the thread run through a bath containing the treatment liquid that it is desired to deposit. By dipping the thread into the bath, it is impregnated with the liquid solution and then emerges therefrom, going towards the treatment step during which the drying or curing takes place.

However, it has been observed that, depending on the nature of the thread or the liquid to be deposited, the thread could behave as a veritable pump, capable of entraining therewith an amount of liquid much greater than the necessary amount. This pumping effect is associated with parameters such as the viscosity of the liquid, the difference in surface tension between the thread and the treatment substance in liquid form, and the run speed of the thread through the bath.

This is why it is recommended to use one or more sets of scrapers or wipers, placed at the outlet of the dipping bath and capable of extracting the superfluous amount of liquid. However, these means may prove to be limited in so far as they are themselves liable to become blocked owing to the many contacts existing between the thread and the draining means, thereby limiting their capability of fulfilling their function, in particular when, for obvious productivity reasons, it is desired to increase the run speed of the thread. One object of the invention is to provide a solution to this problem. Such a device is described by way of example in the publication DE 43 08 889.

SUMMARY OF THE INVENTION

A device according to one aspect of the invention for continuously depositing a treatment substance on the surface of a thread comprises:

- impregnation means for impregnating the thread by dipping it into a bath designed to contain a solution of the treatment substance in liquid form, through which bath the thread runs when the device is in operation;
- draining means, placed downstream of the impregnation means, capable of removing the excess liquid entrained by the thread;
- treatment means placed downstream of the draining means, capable of making the liquid solution remaining on the thread solidify; and
- means suitable for guiding and running the thread from the inlet to the outlet of the device along a direction $d_f$ and at a speed $V_f$.

This device is characterized in that the draining means include means capable of spraying said treatment liquid with an appropriately regulated velocity $V_j$ towards the thread in the form of jets that converge in directions $d_j$ making an obtuse angle $\alpha$ with the direction $d_f$ in which said thread runs, so as to adjust the thickness e of liquid remaining on the thread on leaving said draining means.

The jets therefore spray the liquid onto the thread with a velocity having one component which is parallel to the thread but in the opposite direction to that in which the thread advances, this having the effect of wiping off the excess liquid entrained by the thread.

By judiciously adjusting the speed of the thread or the velocity and the spray rate of the liquid, it is then possible for the amount of treatment liquid deposited per unit length of thread leaving the device to be precisely regulated.

It should also be noted that the thread runs through the draining means without coming into contact with said means. It follows that, advantageously, it is possible to run the thread through the treatment device between the outlet of the impregnation means and the outlet of the processing means without said thread coming into contact with the guiding means. This advantage may prove to be decisive for regulating the amount of treatment substance on the thread without this amount being altered by the thread rubbing on a pulley or a capstan.

It is also possible to vary the spray angle of the jets so as to obtain a similar effect. However, it turns out that an angle which is too low or close to 180° does not allow the liquid to effectively wipe the surface of the thread, while too high an angle, close to 90°, forces the "pumping" of the liquid by the thread to increase. It has thus been found that an angle between 120° and 160° gives good results.

BRIEF DESCRIPTION OF THE ONLY DRAWING

FIG. 1 shows a schematic view of a device according to an embodiment of the invention in the operating condition.

DETAILED DESCRIPTION OF THE DRAWINGS

The device serving as the basis for the present description comprises impregnation means 2, draining means 3, treatment means and means formed by turn pulleys, capable of making a thread 10 run, from the inlet (51) to the outlet (54) of the device, between and through the impregnation means (52, 53).

The impregnation means 2 are for example formed by a tank 25 containing a treatment liquid 20. This treatment liquid may be a solute diluted in a solvent or else an organic compound capable of curing under the action of heat or an energy source, such as laser or UV radiation.

The continuous thread 10 is driven through the tank 25 by drive means (not shown) such as a motorized pulley, from a thread source (not shown). The thread moves through the treatment device at a speed $V_f$. On leaving the device the thread may be repackaged for the purpose of a subsequent production step, or integrated directly into the material to be reinforced.

On leaving the treatment bath 2, the thread 10 is impregnated with the treatment liquid 20, which also forms a film 23 over the entire surface of the thread. As has already been mentioned above, it has been observed that the thread acts as a pump and that the amount of treatment liquid 23 entrained by the thread increases when the run speed $V_f$ increases. Thus, when it is desired to increase the speed $V_f$ for obvious productivity reasons, the amount of liquid deposited on the thread increases, and it is absolutely necessary to regulate the liquid thickness e (see inset).

The draining means are formed by a central channel 34 through which the thread 10 runs at the speed $V_f$ in a direction $d_f$ corresponding approximately to the longitudinal direction of the channel 34. The draining means 3 may advantageously be oriented so that the run direction $d_f$ of the thread is directed vertically upwards.

The draining means 3 also include an inlet 31 via which the pressurized treatment liquid 20 enters a chamber 32. The treatment liquid is expelled by nozzles 33 in the form of jets 21 which converge on the thread 10 with the velocity $V_j$. The jets are oriented so that the spray direction $d_j$ of liquid onto the thread makes an obtuse angle $\alpha$ with the run direction $d_f$ of the thread.

The collision of the jets 21 on the surface of the thread 10 has the effect of ejecting the excess liquid in the form of splashes 22, which can be recovered in a container of suitable shape. For this purpose, and by way of illustration, the wall 26 of the tank 25 may be raised to ensure that this excess treatment liquid falls into the tank 25 under gravity.

A recirculation pump 27 draws up the treatment liquid via a duct 28 so as to supply the pressurized chamber 32.

Thus, for a thread speed $V_f$, the velocity $V_j$ and the output flow rate of the jets 21 of the treatment liquid are adjusted by varying the flow rate and the output pressure of the pump 27 so as to obtain a liquid thickness e deposited on the thread which is constant on leaving the draining means 3. This regulating means makes it possible, among other things, to circumvent any irregularity due to the transient phases or to the variations in speed imposed by the speed of the thread by a process located upstream or downstream of the treatment device forming the subject matter of the present invention.

Finally, it is also possible to modify the angle $\alpha$. Increasing the angle $\alpha$ has the effect of reducing the liquid thickness e entrained by the thread. However, this regulating means proves to be more difficult to implement. Consequently, it is preferred to determine an angle between the rows given above and to vary the run speed $V_f$ or the ejection velocity $V_j$ simultaneously or separately in order to regulate the liquid thickness deposited on the thread.

In order for the system to be effective, it is advantageous to make the jets converge precisely on the thread and to ensure that the sum of the components perpendicular to the direction of the thread of the vectors, representing the momentum of each of the jets, is approximately equal to zero so as not to induce forces perpendicular to the thread that could shift it towards the walls of the channel 34.

In practice, assuming that the ejection velocities and the flow rates of each of the nozzles are the same, measures are taken to ensure that the components perpendicular to the run direction of the thread of the velocity vector $V_f$ of each of the jets have approximately equal moduli and that the jets are placed around the central channel 34 so that these vector values cancel out. This amounts to placing the nozzles at the vertices of a regular polygon lying in a plane perpendicular to the direction $d_f$, the centre of the polygon corresponding to the point through which the thread passes.

By extension, it is thus possible to design a circular nozzle, the internal walls $\mathbf{33}_a$, $\mathbf{33}_b$ of which take the form of nested cone frustums, the axis of which corresponding approximately to the axis of the channel 34, and a generatrices of which make an external angle equal to the angle $\alpha$.

These draining means have the particular benefit of being able to be simply regulated according to the run speed $V_f$ of the thread, unlike the conventional draining means such as wiping rollers that have the drawback of becoming saturated when the amount of excess liquid to be removed becomes too great.

The matching of the spray velocities and flow rates to the run speed of the thread must be accomplished within the limits imposed by the nature and the physical characteristics of the thread and of the liquid to be sprayed, the main descriptors of which are the viscosity, the wettability and the surface finish of the thread.

Placed downstream of the draining means 3 are the treatment means 4, these having the purpose of fixing the treatment liquid and of making said liquid pass from the liquid phase to the solid or plastic phase. These means may, as an example, comprise heating means for evaporating the solvent of the treatment liquid or initiating a curing reaction, which will set the treatment product on the surface of the thread 10. This reaction may be produced by other means, such as induction heating means, UV radiation or laser radiation, or any other means capable of making the treatment substances contained in the treatment liquid adhere to the surface of the thread.

One of the advantageous features of the device according to the invention is that it is possible to make the thread run from the outlet of the impregnation means 2, indicated by the line AA, to the outlet of the treatment means 4, indicated by the line BB, without the thread coming into contact with the walls of the channel 34, or with a turn pulley belonging to the guiding system. The thread runs freely between the turn pulleys 53 and 54. This advantageously eliminates all the causes liable to alter the form of the film of treatment liquid until the latter has finally solidified on leaving the treatment means 4.

The invention claimed is:

1. A device for continuously depositing a treatment substance on the surface of a thread running from an inlet to an outlet of the device, comprising:

impregnation means, including a bath configured to contain a solution of the treatment substance in liquid form, for impregnating the thread with said liquid solution by running the tread through said bath;

draining means, placed downstream of said bath, for removing excess liquid entrained by the thread;

treatment means, placed downstream of said draining means, for solidifying said liquid solution remaining on the thread;

guiding means for guiding and running the thread from the inlet to the outlet of the device along guided directions of the thread including a run direction $d_f$ and at a run speed $V_f$; and regulating means for regulating a liquid spray velocity $V_j$ according to said run speed $V_f$ of the thread so as to adjust thickness of said liquid solution on the thread when leaving said draining means to a thickness 'e', wherein said draining means includes spraying means for spraying said liquid solution with said liquid spray velocity $V_j$ towards the thread in the form of jets that converge in directions $d_j$, and wherein said directions $d_j$ make an obtuse angle $\alpha$ with said run direction $d_f$ so as to adjust said thickness of said liquid solution remaining on the thread when leaving said draining means to said thickness 'e'.

2. The device according to claim 1, wherein a straight channel passes through said draining means, and wherein the thread runs through said straight channel when the device is in operation.

3. The device according to claim 2, wherein, when the device is in operation, the thread runs through said draining means without coming into contact with the walls of said straight channel of said draining means.

4. The device according to claim 3, wherein, when the device is in operation, the thread runs between the outlet of said impregnation means and the outlet of said treatment means without coming into contact with said guiding means.

5. The device according to claim 2, wherein said draining means comprises a single circular nozzle, wherein the internal walls of said circular nozzle take the form of nested cone frustums, wherein the vertical axis of said circular nozzle corresponds approximately to the vertical axis of said straight channel, and wherein the generatrices of said circular nozzle make with said direction $d_f$ an external angle approximately equal to said obtuse angle $\alpha$.

6. The device according to claim 2, wherein said jets are directed near the inlet of said draining means such that said thickness 'e' of said liquid solution remaining on the thread is adjusted when entering said straight channel of said draining means.

7. The device according to claim 1, wherein said obtuse angle $\alpha$ is between 120° and 160° C.

8. The device according to claim 1, wherein regulating said liquid spray velocity $V_j$ includes adjusting the flow rate and the pressure of said liquid solution sprayed onto the thread.

9. The device according to claim 1, wherein said bath is further configured to capture said excess liquid removed by said draining means and further comprising supplying means for supplying said liquid solution to said draining means from said bath.

10. A device for continuously depositing a treatment substance on the surface of a moving thread, the device comprising:

a tank configured to contain a liquid solution of the treatment substance, wherein said liquid solution is used to deposit the treatment substance on the surface of the moving thread;

a pump configured to draw up said liquid solution from said tank and pressurize said liquid solution;

a pressurized chamber comprising an inlet, a central channel and at least one nozzle, wherein said inlet is coupled to said pump, wherein said pressurized liquid solution is supplied by said pump to said pressurized chamber through said inlet, wherein said at least one nozzle is directed to spray said received pressurized liquid solution towards the moving thread in a form of jets with a spray velocity, wherein said jets converge on the moving thread to adjust a thickness of said liquid solution remaining on the moving thread by removing excess liquid entrained by the moving thread, wherein the moving thread runs through said central channel of said pressurized chamber at a run speed, and wherein said pump is configured to regulate said spray velocity according to said run speed of the moving thread so as to adjust thickness of said liquid solution on the moving thread to a thickness 'e' after passing said at least one nozzle;

a treatment apparatus arranged downstream of said pressurized chamber such that the moving thread runs therethrough, wherein said treatment apparatus is adapted to solidify the treatment substance contained in said liquid solution onto the surface of the moving thread; and at least one motorized pulley arranged to guide and run continuously at said run speed the moving thread through said tank, past said jets, and through said central channel of said pressurized chamber and said treatment apparatus, wherein said running speed of the thread is preset and controlled.

11. The device of claim 10, wherein said pump is configured to draw up said liquid solution from said tank through a duct.

12. The device of claim 10, wherein regulating said spray velocity includes adjusting the flow rate and the pressure of said liquid solution sprayed onto the moving thread.

13. The device of claim 10, wherein, when the device is in operation, the moving thread runs through the outlet of said tank and the outlet of said treatment apparatus without coming into contact with any of said set of motorized pulleys.

14. The device of claim 10, wherein said tank is open and further configured to collect said excess liquid that is ejected when said liquid solution sprayed from said at least one nozzle collides with the moving thread.

15. The device of claim 10, wherein said at least one nozzle includes a circular nozzle.

16. The device of claim 10, wherein said at least one nozzle is arranged such that a sum of vector components of said jets that are perpendicular to the direction of the moving thread is approximately zero.

17. The device of claim 10, wherein said jets converge on the moving thread in directions that make an obtuse angle with the run direction of the moving thread.

18. The device of claim 17, wherein said obtuse angle is between 120° and 160° C.

* * * * *